US007036326B2

(12) United States Patent
Allison

(10) Patent No.: US 7,036,326 B2
(45) Date of Patent: May 2, 2006

(54) BEVERAGE DISPENSING SYSTEM

(75) Inventor: Matthew Allison, Mundelein, IL (US)

(73) Assignee: Scotsman Ice Systems, Vernon Hills, IL (US)

( * ) Notice: Subject to any disclaimer, the term of this patent is extended or adjusted under 35 U.S.C. 154(b) by 0 days.

(21) Appl. No.: 10/910,247

(22) Filed: Aug. 3, 2004

(65) Prior Publication Data

US 2005/0056044 A1 Mar. 17, 2005

Related U.S. Application Data

(60) Provisional application No. 60/502,048, filed on Sep. 11, 2003.

(51) Int. Cl.
*F25C 1/00* (2006.01)

(52) U.S. Cl. ..... 62/59; 62/66; 62/340; 62/389

(58) Field of Classification Search ..... 62/340–356, 62/389–400, 59, 66–74; 222/146.6
See application file for complete search history.

(56) References Cited

U.S. PATENT DOCUMENTS

| | | | | |
|---|---|---|---|---|
| 5,419,461 | A * | 5/1995 | Goulet | 222/129.1 |
| 5,987,900 | A * | 11/1999 | Love | 62/66 |
| 5,996,842 | A * | 12/1999 | Riley et al. | 222/1 |
| 6,034,872 | A * | 3/2000 | Chrysler et al. | 361/699 |
| 6,167,621 | B1 * | 1/2001 | Goth et al. | 29/890.054 |
| 6,725,687 | B1 * | 4/2004 | McCann et al. | 62/389 |
| 2001/0000880 | A1 * | 5/2001 | Chu et al. | 165/263 |
| 2004/0069004 | A1 * | 4/2004 | Gist et al. | 62/340 |

* cited by examiner

*Primary Examiner*—William E. Tapolcai
(74) *Attorney, Agent, or Firm*—Ohlandt, Greeley, Ruggiero & Perle, L.L.P.

(57) ABSTRACT

A beverage dispenser is provided that stores ice and has a cold plate. The cold plate is provided with refrigerant and/or ice water drainage for cooling of the beverage upon dispensing.

15 Claims, 1 Drawing Sheet

BEVERAGE DISPENSING SYSTEM

RELATED APPLICATION

This application is related to, and claims priority in, co-pending U.S. Provisional Application Ser. No. 60/502,048, filed Sep. 11, 2003, the disclosure of which is incorporated herein by reference.

BACKGROUND OF THE INVENTION

1. Field of the Invention

This invention relates to a beverage dispenser. More particularly, this invention is related to a beverage dispenser having a cold plate.

2. Discussion of the Background Art

Beverage dispensing machines generally comprise one or more beverage dispensing valves connected to one or more corresponding beverage sources, and an ice storage bin. The location of the ice storage bin in proximity to the beverage dispenser facilitates making cold beverages through the addition of ice.

In contemporary beverage dispensing machines, the ice storage bin may contain a cold plate. The cold plate is designed to allow flow of the beverage from the beverage source through the cold plate and to the beverage dispensing valves. Some of the ice in the ice storage bin is used to cool the cold plate and the beverage as it flows through the cold plate, which results in melting of the ice.

The contemporary machine described-above suffers from the drawback of requiring manual loading of the ice into the ice storage bin. The machine further suffers from the drawback of requiring melting of the ice for cooling of the cold plate. This necessitates frequent loading of the ice, which is labor-intensive and expensive.

The contemporary machine also suffers from the drawback of failing to provide beverages that have been adequately cooled to a desired temperature. This drawback is exacerbated when the beverage dispenser is being frequently used and the beverage is disposed in the cold plate for only a limited amount of time due to frequent or constant flow of the beverage. Additionally, melting of the ice within the ice storage bin introduces other problems, such as more frequent cleaning and the requirement of larger capacity drainage.

Thus, there is a need for a beverage dispensing system that creates its own ice. There is also a need for an efficient way of maintaining the ice at a desired temperature and reducing melting. There is a further need for an efficient way of dispensing the beverage at a desired temperature. There is yet a further need for facilitating the dispensing of ice and beverages.

SUMMARY OF INVENTION

The beverage dispensing system of the present invention satisfies these needs with a cold plate for use with a beverage dispenser, a beverage source providing a beverage, and a circuit having refrigerant flowing therethrough. The cold plate comprises a first conduit and a second conduit. The first conduit is connectable to the beverage dispenser and the beverage source to provide for fluid communication of the beverage. The second conduit is connectable to the circuit to provide for fluid communication of the refrigerant. The first and second conduits are in thermal contact with each other, thereby cooling the beverage with the refrigerant.

In another aspect, a cold plate for use with a beverage dispenser, a beverage source having a beverage, and an ice-making machine having ice-water drainage, is provided. The cold plate comprises a first conduit and a second conduit. The first conduit is connectable to the beverage dispenser and the beverage source to provide for fluid communication of the beverage. The second conduit is connectable to the ice-making machine to provide for fluid communication of the ice-water drainage. The first and second conduits are in thermal contact with each other, thereby cooling the beverage with the ice-water drainage.

In another aspect, a beverage dispensing system for use with a beverage source, a water supply and a circuit having an evaporator, a compressor, and a condenser, is provided. The system comprises a housing, a beverage dispenser valve, an ice storage bin and a cold plate. The beverage dispenser valve is connected to the housing. The ice storage bin is disposed in the housing. The cold plate is also disposed in the housing. The cold plate is connected to the beverage dispenser valve and is connectable with the beverage source to provide for fluid communication. The cold plate is also connectable to the circuit, thereby supplying refrigerant to the cold plate.

In another aspect, a beverage and ice dispensing system for use with a water supply and a beverage source, is provided. The system comprises a beverage dispenser, a compressor unit, a condenser unit, and a circuit. The beverage dispenser comprises an evaporator, a beverage dispenser valve, an ice storage bin and a cold plate. The evaporator is operably connected to the water supply. The beverage dispenser valve is in fluid communication with the cold plate and the beverage source. The compressor unit comprises a compressor. The condenser unit comprises a condenser. The circuit comprises a plurality of conduits that connect the evaporator, the compressor, the condenser and the cold plate for circulation of refrigerant through the conduits, thereby forming ice at the evaporator and cooling the cold plate.

In another aspect, a method of dispensing ice and beverage from a water supply and a beverage source, is provided. The method comprises:

(a) positioning an evaporator in close proximity to a beverage dispenser and remotely from a compressor and a condenser, with the evaporator being operably connected to the water supply, and with the beverage dispenser being in fluid communication with the beverage source;

(b) providing refrigerant substantially in liquid phase to the evaporator from the condenser during a freeze cycle;

(c) providing the refrigerant substantially in vapor phase to the evaporator from the compressor during a harvest cycle, whereby flow of the refrigerant is limited during the harvest cycle such that the pressure and temperature of the refrigerant in the evaporator increases to assist in defrosting the evaporator, thereby forming the ice at the evaporator from the water supply;

(d) maintaining a temperature of the beverage at a desired temperature by use of a cold plate in fluid communication with the beverage source for the flow of beverage therethrough, with the cold plate being in circuit with the evaporator, the condenser and the compressor for the flow of refrigerant therethrough, thereby cooling the beverage; and (e) dispensing the ice and/or dispensing the beverage.

The first and second conduits can be channels formed through the housing. The first and second conduits may also be disposed relative to each other in the housing to maximize their thermal contact area for cooling of the beverage flowing therethrough. The beverage dispenser can be located remotely from the compressor unit and the condenser unit. The evaporator may be disposed adjacent to the ice storage bin so that ice is formed in the ice storage bin from the water supply. The beverage dispenser or housing can have an ice chute so that the ice is dispensed from the ice storage bin through the ice chute.

The beverage dispenser valve may be a plurality of beverage dispenser valves that are each connectable with the beverage source and cold plate to provide for fluid communication. The beverage dispenser or housing can also have a drain operably disposed with respect to the beverage dispenser valve. The plurality of conduits may include, but are not limited to, a supply line, a return line, and an interconnection line. The supply line provides refrigerant to the evaporator. The return line removes refrigerant from the cold plate. The interconnection line supplies refrigerant from the evaporator to the cold plate.

BRIEF DESCRIPTION OF THE DRAWING

Other and further objects, advantages and features of the present invention will be understood by reference to the following specification in conjunction with the accompanying drawing.

DETAILED DESCRIPTION OF THE INVENTION

Figure 1:
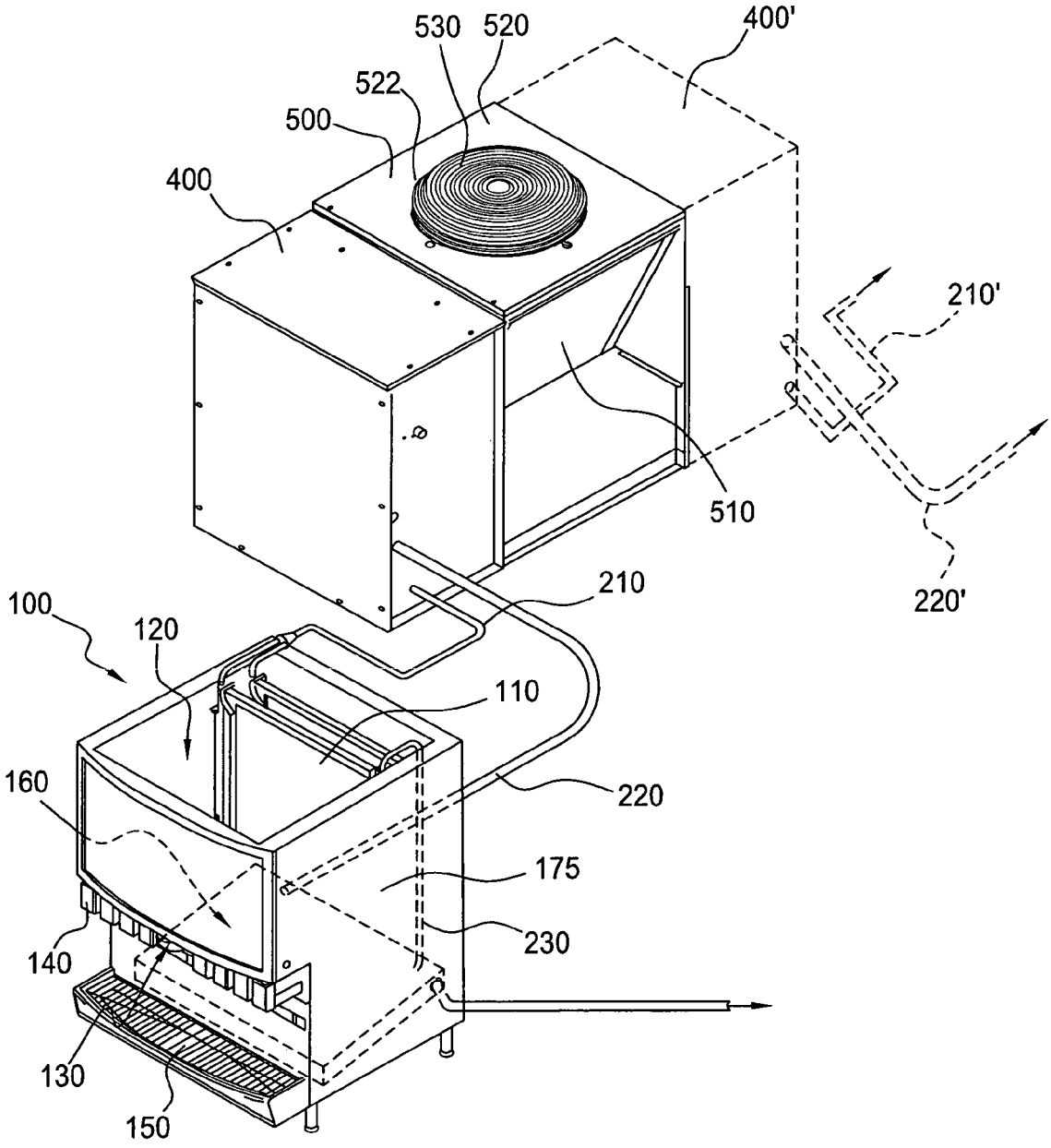
FIG. 1 is a perspective view of the beverage dispensing system of the present invention coupled to an ice-making machine.

Referring to FIG. 1, a beverage or liquid dispenser is shown and generally represented by reference numeral 100. Dispenser 100 has evaporators 110, an ice hopper or storage bin 120, an ice dispenser 130, beverage dispenser valves 140, a drain 150 and a cold plate 160.

In the preferred embodiment, dispenser 100 forms ice in ice storage bin 120 through use of evaporators 110. Evaporators 110 are coupled to a compressor unit 400 and a condenser unit 500 by way of a supply line 210 for supplying the refrigerant and a return line 220 for returning the refrigerant. However, one of ordinary skill in the art could use dispenser 100 with alternative ice-making components, connections, or without the ice-making components but attached to alternative refrigerant and/or coolant supplies, and/or where ice storage bin 120 requires manual loading of the ice.

Preferably, these components of dispenser 100 are integrally connected in a dispenser housing 175, which forms a unitary device. However, the present disclosure contemplates the use of other designs and support structures or housings to provide ice storage bin 120, ice dispenser 130, beverage dispenser valves 140, drain 150, and/or evaporators 110 in operable communication with each other. These components are preferably in close proximity and usable with one another, but may alternatively be unattached to each other.

Supply and return lines 210, 220 may suitably include pipes, conduits or tubing and appropriate joining junctions, which place the evaporators 110 in fluid communication with the compressor (not shown) of compressor unit 400, the condenser 510 of condenser unit 500 and other components for the supply of refrigerant, such as, for example, alternative types of ice-making machines, for the circulation of the refrigerant. In this exemplary embodiment, two evaporators 110 are shown, although any number of evaporators can be used.

The dispenser 100 provides for formation of ice during freezing and harvesting cycles, as well as dispensing of the ice at the same location as the dispensing of the beverages through beverage dispenser valves 140. This preferably avoids time-consuming and labor-intensive manual loading of the ice storage bin 120, and provides easy access to both beverages and ice.

The evaporators 110 are operably connected to a water supply (not shown) to provide water for the formation of the ice at the evaporators to be stored in ice storage bin 120. Ice dispenser 130 can be a chute, or other type of dispenser, such as, for example, gravity actuated or power actuated, which preferably provides ice to the user upon demand. The dispenser 100 includes a drain 150 for overflow of the beverages from the beverage dispenser valves 140, as well as for dispensed ice that goes unused. The beverage dispenser valve 140 can be any number or plurality of beverage dispenser valves, which are each in fluid communication with one or more different beverage sources to provide a variety of beverages or liquids.

Dispenser 100 has a cold plate 160 disposed in ice storage bin 120. Cold plate 160 is connected to a beverage source (not shown) by beverage conduit 240. The cold plate 160 is also connected to beverage dispenser valves 140 for the dispensing of the one or more liquids or beverages from the beverage source (not shown). Cold plate 160 cools the beverages as they flow through the cold plate to the dispensing valves 140.

Preferably, cold plate 160 has channels or conduits through which the beverage, liquid, and/or syrup flows from the beverage source (not shown) to the beverage dispensing valves 140. Dispenser 100 and/or beverage conduit 240 include appropriate interconnection structures, including, but not limited to, conduits and valves, for the storage, mixing and dispensing of the desired beverages, which may include one or more beverages that require mixing of one or more components, as well as one or more single component beverages.

Dispenser 100 provides for cooling of cold plate 160, and preferably provides for such cooling in addition to any cooling from the ice stored in ice storage bin 120. In the preferred embodiment, cold plate 160 is in circuit with the compressor (not shown), the condenser 510 and the evaporators 110 for the circulation of the refrigerant through the cold plate. Cold plate 160 has additional channels or conduits (not shown) through which the refrigerant flows. The refrigerant channels in cold plate 160 are in thermal communication with the beverage channels in the cold plate.

The refrigerant channels and beverage channels in cold plate 160 have a size and shape, and are any appropriate arrangement of conduits or other interconnection structures that increase and facilitate the thermal communication and/or thermal contact area between the refrigerant and the beverages, facilitate the flow of the refrigerant through the cold plate, and facilitate the flow of the beverages through the cold plate. While the preferred embodiment describes cold plate 160 as a structure having channels or conduits disposed therethrough or formed therein, the present disclosure contemplates the use of other interconnection structures that increase and facilitate the thermal communication between the refrigerant and the beverages, facilitate the flow of the refrigerant, and facilitate the flow of the beverages. Preferably, evaporators 110 provide the refrigerant to the cold plate 160 through interconnection line 230. The cold plate provides the refrigerant back to the compressor unit 400 through return line 220.

While the preferred embodiment cools cold plate 160 through refrigerant that is supplied from evaporators 110 through interconnection line 230, the present disclosure contemplates other methods for cooling of the cold plate that are preferably in addition to any cooling from the ice stored in ice storage bin 120. In an alternative embodiment, cold plate 160 has channels or conduits disposed therethrough or formed therein for the flow of ice-water drainage from the ice machine. These channels, and the ice-water drainage flowing therethrough, are in thermal contact with the beverage channels in the cold plate 160, and provide cooling to the beverages.

Cold plate 160 is preferably disposed along the bottom of housing 175, under and adjacent to the volume that comprises ice storage bin 120. However, the present disclosure contemplates alternative positionings of cold plate 160, such as, for example, substantially surrounding the ice storage bin 120. The cold plate 160 is preferably made of one or more materials having good thermal conductive properties, such as, for example, aluminum, to facilitate the thermal communication between the refrigerant flowing therethrough and the beverages flowing therethrough. Also, the cold plate 160 can be made of material having good thermal conductive properties to facilitate the thermal communication between the ice stored in ice storage bin 120 and the refrigerant and beverages flowing through cold plate 160.

Housing 175 preferably has insulation or the like to facilitate maintaining a desired temperature of the ice in ice storage bin 120, as well as attaining the desired temperature of the beverages flowing through cold plate 160. While in the preferred embodiment, ice storage bin 120 is defined by dispenser housing 175 and cold plate 160, the present disclosure contemplates alternative designs and structures for the ice storage bin, such as, for example, a removable ice storage bin, which facilitates cleaning.

In the preferred embodiment, dispenser 100 is coupled to a two package ice-making machine, e.g., the first package being evaporators 110 and the second package being the compressor and condenser units 400, 500. The two-package system shown in FIG. 1 provides for the use of multiple beverage dispensers 100 and 100' (not shown). Condenser unit 500 can have a second compressor unit 400' (shown in phantom) coupled thereto on the opposing side from the first compressor unit 400. The second compressor unit 400' can be in circuit with a second condenser (not shown) contained in condenser unit 500, and in circuit with the second beverage dispenser 100' (not shown) through use of supply and return lines 210', 220' (shown in phantom).

The first condenser 510 and the first compressor (not shown) are adapted to connect with one another to form a first refrigerant circuit (not shown) that includes evaporators 110, supply, return and interconnection lines 210, 220, 230 and other typical refrigerant components. The second condenser (not shown) and the second compressor (not shown) are also adapted to connect with one another in a second refrigerant circuit (not shown) that includes evaporators of the second dispenser 110' (not shown), supply and return lines 210', 220', and other typical refrigerant components. The first and second refrigeration circuits may be any suitable refrigeration circuits and components known in the art or known in the future.

First condenser 510 and the second condenser (not shown) rest in a support structure 520. In the preferred embodiment, support structure 520 has a box-like configuration having an aperture 522. Aperture 522 is a suitable size for allowing a fan 530 access to air to circulate and cool both the first condenser 510 and the second condenser (not shown). The first condenser 510 and the second condenser (not shown) are preferably disposed in support structure 520 in a V-like configuration. It should be appreciated by one skilled in that art that although first condenser 510 and second condenser (not shown) are connected to the support structure 520 in a V-like configuration, the first and second condensers may be arranged in any configuration so as to create a compact configuration of multiple condensers and/or to provide for air flow from the fan 530 to both of the first and second condensers.

The use of multiple beverage dispensers 100, 100' provides for the efficient dispensing of beverages and ice, while also efficiently dispensing the beverages at desired temperatures and storing of the ice at multiple locations in a facility, such as, for example, a plurality of vending stations at a movie theatre or the like. Dispenser 100 is disposed in an area accessible to users and is remotely located from the compressor unit 400 and the condenser unit 500. In an exemplary embodiment, dispenser 100 is part of the two-package system described-above where the dispenser is remotely located from the compressor and condenser units 400, 500 for quiet operation. However, the present disclosure contemplates the use of the dispenser 100 with a three-package system, where the dispenser, the compressor unit 400 and the condenser unit 500 are all located remotely of each other, as well as other arrangements of ice-making machines.

While the instant disclosure has been described with reference to one or more exemplary or preferred embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A beverage and ice dispensing system for use with a beverage source, a water supply and a refrigerant circuit having a compressor and a condenser, the system comprising:

a housing;

a beverage dispenser valve connected to said housing;

an ice storage bin disposed in said housing;

an evaporator in said housing and adjacent said ice storage bin for supplying ice thereto, said evaporator being connected to said refrigerant circuit and a cold plate disposed in said housing, said cold plate being connected to said beverage dispenser valve and connectable with said beverage source to provide for fluid communication, wherein said cold plate is connected to said refrigerant circuit, thereby supplying refrigerant to said cold plate.

2. The system of claim 1, wherein said cold plate comprises a first conduit and a second conduit, said first conduit being connected to said beverage dispenser valve and connectable with said beverage source to provide for fluid communication, said second conduit being connectable to said refrigerant circuit to provide for fluid communication of said refrigerant, and wherein said first and second conduits are in thermal contact with each other.

3. The system of claim 1, wherein said cold plate is connected in said refrigerant circuit downstream of said evaporator by an interconnection line.

4. The system of claim 3, wherein said housing further comprises an ice chute which is capable of dispensing said ice from said ice storage bin.

5. The system of claim 1, wherein said beverage dispenser valve is a plurality of beverage dispenser valves, each of said beverage dispenser valves being in fluid communication with said cold plate.

6. The system of claim 1, wherein said housing further comprises a drain operably disposed with respect to said beverage dispenser valve.

7. A beverage and ice dispensing system for use with a water supply and a beverage source, the system comprising:

a beverage dispenser comprising a housing having an evaporator, a beverage dispenser valve, an ice storage bin and a cold plate, said evaporator being operably connected to said water supply for supplying ice to said ice storage bin, said beverage dispenser valve being in fluid communication with said cold plate and said beverage source;

a compressor unit comprising a compressor;

a condenser unit comprising a condenser; and a circuit comprising a plurality of conduits that connect said evaporator, said compressor, said condenser and said cold plate for circulation of refrigerant through said conduits, thereby forming said ice at said evaporator and cooling said cold plate.

8. The system of claim 7, wherein said cold plate comprises a first conduit and a second conduit, said first conduit being connected to said beverage dispenser valve and said beverage source to provide for fluid communication, said second conduit being connected to said circuit to provide for fluid communication of said refrigerant, and wherein said first and second conduits are in thermal contact with each other.

9. The system of claim 7, wherein said beverage dispenser is located remotely from said compressor unit and said condenser unit.

10. The system of claim 7, wherein said cold plate is connected in said circuit downstream of said evaporator by an interconnection line.

11. The system of claim 10, wherein said beverage dispenser further comprises an ice chute which is capable of dispensing said ice from said ice storage bin.

12. The system of claim 7, wherein said beverage dispenser valve is a plurality of beverage dispenser valves, each of said beverage dispenser valves being in fluid communication with said cold plate and said beverage source.

13. The system of claim 7, wherein said beverage dispenser further comprises a drain operably disposed with respect to said beverage dispenser valve.

14. The system of claim 7 wherein said conduits comprise a supply line, a return line, and an interconnection line, said supply line providing refrigerant to said evaporator, said return line removing refrigerant from said cold plate, and said interconnection line supplying refrigerant from said evaporator to said cold plate.

15. A method of dispensing ice and beverage from a water supply and a beverage source, the method comprising:

positioning an evaporator in close proximity to a beverage dispenser and remotely from a compressor and a condenser, said evaporator being operably connected to said water supply, said beverage dispenser being in fluid communication with said beverage source;

providing refrigerant substantially in liquid phase to said evaporator from said condenser during a freeze cycle;

providing said refrigerant substantially in vapor phase to said evaporator from said compressor during a harvest cycle, flow of said refrigerant being limited during said harvest cycle, whereby the pressure and temperature of said refrigerant in said evaporator increases to thereby assist in defrosting said evaporator, said ice being formed at said evaporator from said water supply;

maintaining a temperature of said beverage at a desired temperature by use of a cold plate in fluid communication with said beverage source for the flow of beverage therethrough, said cold plate being in circuit with said evaporator, said condenser and said compressor for the flow of refrigerant therethrough, thereby cooling said beverage; and dispensing said ice and/or dispensing said beverage.

* * * * *